US007690171B2

(12) United States Patent
Merusi

(10) Patent No.: US 7,690,171 B2
(45) Date of Patent: Apr. 6, 2010

(54) MACHINE FOR FILLING SEALED SOFT CONTAINERS IN AN ASEPTIC ENVIRONMENT, AND METHOD FOR THEIR FILLING

(75) Inventor: Pier Luigi Merusi, Parma (IT)

(73) Assignee: FBR-ELPO-Societa per Azioni, Parma (IT)

( * ) Notice: Subject to any disclaimer, the term of this patent is extended or adjusted under 35 U.S.C. 154(b) by 40 days.

(21) Appl. No.: 11/910,114

(22) PCT Filed: Mar. 30, 2005

(86) PCT No.: PCT/EP2005/003490

§ 371 (c)(1),
(2), (4) Date: Sep. 28, 2007

(87) PCT Pub. No.: WO2006/102921

PCT Pub. Date: Oct. 5, 2006

(65) Prior Publication Data

US 2008/0178558 A1 Jul. 31, 2008

(51) Int. Cl.
*B65B 3/04* (2006.01)

(52) U.S. Cl. ..... 53/284.7; 53/268; 53/386.1

(58) Field of Classification Search ..... 53/425, 53/167, 268, 284.7, 386.1
See application file for complete search history.

(56) References Cited

U.S. PATENT DOCUMENTS

| | | | | | |
|---|---|---|---|---|---|
| 3,299,603 | A | * | 1/1967 | Shaw | 53/426 |
| 3,486,295 | A | * | 12/1969 | Tuma et al. | 53/426 |
| 3,851,444 | A | * | 12/1974 | Merat | 53/167 |
| 4,171,604 | A | * | 10/1979 | Weikert | 53/426 |
| 4,360,996 | A | * | 11/1982 | Rutter | 53/284.7 |
| 4,452,030 | A | * | 6/1984 | Inada | 53/426 |
| 4,494,363 | A | * | 1/1985 | Rica et al. | 53/426 |
| 4,581,874 | A | | 4/1986 | Rechtsteiner | |
| 2003/0182901 | A1 | | 10/2003 | Savage | |

FOREIGN PATENT DOCUMENTS

WO 9115401 A1 10/1991

* cited by examiner

*Primary Examiner*—Louis K Huynh
(74) *Attorney, Agent, or Firm*—Browdy & Neimark, PLLC

(57) ABSTRACT

A machine for filling a sealed soft container (2) with fluid material in an aseptic condition comprises a sealing box (3) comprising two complementary half-boxes (4*a* & 4*b*) having respective sealing edges (21, 22, 23) that can be brought into mutual contact to isolate their interior from the outside environment when the complementary half-boxes (4*a* & 4*b*) are clamped together, vertical and horizontal blades located in the sealing box (3) for forming an aperture (5) in a portion of the container (2) inserted in the sealing box (3), filling device (8, 9) for filling the container (2) through the aperture (5), suckers (28*a*) for widening the aperture (5), and welding device (32) for sealing the aperture (5) on termination of filling.

12 Claims, 12 Drawing Sheets

MACHINE FOR FILLING SEALED SOFT CONTAINERS IN AN ASEPTIC ENVIRONMENT, AND METHOD FOR THEIR FILLING

TECHNICAL FIELD

The present invention relates to a machine for filling sealed soft containers in an aseptic environment, and to a method for their filling.

More particularly, the present invention relates to a machine for filling, in an aseptic environment, internally sterilized sealed stopper-less soft containers with a fluid material, and to a method for their filling with said fluid.

In the present invention a fluid material means any material having the properties of a liquid, pasty, powdery or flaky material, or a material in the form of pieces of various sizes, and in particular a material for food use.

The invention finds its main but non-exclusive application in the food industry for packaging food substances in the fluid state, such as juices, pulps etc. of vegetables, for example tomatoes, fruit, etc.

BACKGROUND ART

Soft containers of the known art are known to comprise a closure stopper which enables the container interior to be separated from the outside. When said containers are to be filled, the stoppers are opened and the containers filled.

This operation must evidently be carried out in an aseptic environment to prevent germs present in the external environment from being able to alter the organoleptic properties and cause growth of pathogenic microorganisms within the container.

Unfortunately the use of stoppers without a seal does not ensure that the container has not been previously opened and therefore contaminated by the external environment.

Moreover the stopper represents an extra cost additional to the container cost and can often exceed the cost of the container itself.

There is also a certain difficulty in obtaining containers having large openings with relative stoppers.

Stoppered containers also present storage problems due to the fact that the stoppers have a certain bulk which cannot be reduced as they are rigid.

There is hence a strong requirement for a machine for filling containers in an aseptic environment in which the containers are stopper-less and are formed simply from two thin sheets (each sheet being formed from one or more layers) sealed along the four sides and internally sterile.

An object of the present invention is to provide a method and a machine for filling, in an aseptic environment, soft containers having structural and functional characteristics such as to satisfy said requirements and at the same time to obviate the stated problems with reference to the known art.

DISCLOSURE OF THE INVENTION

This and further objects are attained by the invention as characterised in the claims.

Generally, the method of the invention comprises the following steps:

a) providing an internally sterile container;

b) inserting a nozzle with a delivery mouth through an aperture formed in the container, c) conveying the fluid material into the container through said mouth, d) extracting the nozzle from the container after conveying the material, e) closing said aperture by sealing the two sheets of the container.

The aperture formed in said step b) can be made by cutting means or by other means, and can be formed either before inserting the nozzle delivery mouth, or as a tear or cut by the delivery mouth itself as it penetrates into the container.

The present invention also defines a machine for implementing the abovementioned method. The dependent claims define particularly advantageous preferred embodiments of the machine for filling soft containers in an aseptic environment according to the invention.

BRIEF DESCRIPTION OF THE DRAWINGS

Further characteristics and advantages of the invention will become apparent on reading the ensuing description provided by way of non-limiting example, with the aid of the figures shown in the accompanying drawings, in which.

BEST MODE FOR CARRYING OUT THE INVENTION

Figure 1:
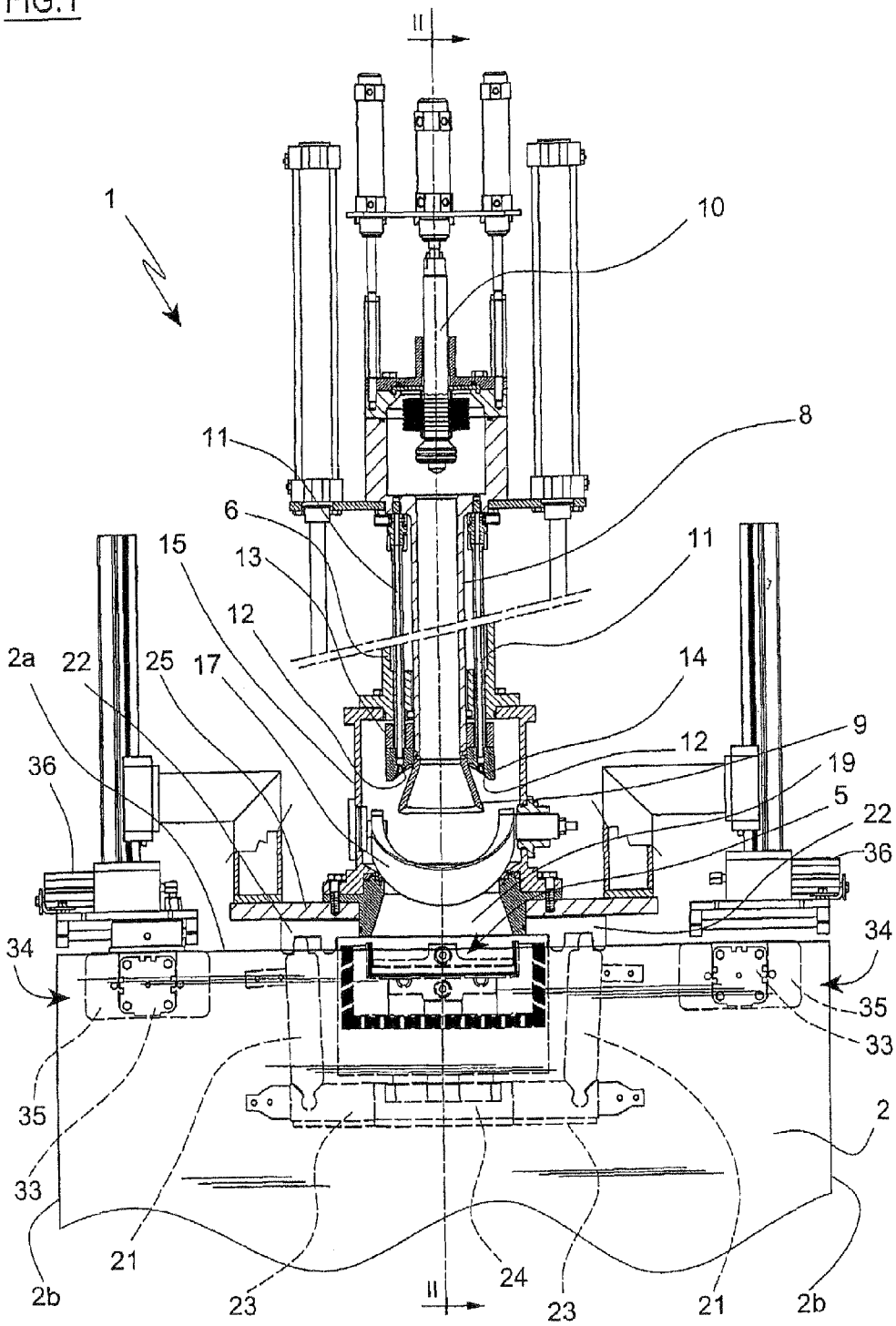
FIG. 1 is a schematic vertical section through a machine according to the present invention.

With reference to said figures, the reference numeral 1 indicates overall a machine for filling soft containers in an aseptic environment, according to the present invention.

Said machine enables the soft container 2, partly shown in FIG. 1, to be filled with a fluid material.

The container 2 of the present invention comprises two thin sheets, each formed from one or more layers, and sealedly joined together along a bounding perimeter comprising an upper side 2*a*, two lateral sides 2*b*, and a lower side, this latter not visible in the figure.

The soft container 2 is internally sterile.

In a preferred embodiment of the present invention, the machine 1 comprises a sealing box 3 comprising two complementary half-boxes 4*a* and 4*b*, clamping means for clamping together and unclamping the two half-boxes 4*a* and 4*b*, aperture-forming means for forming an aperture 5 in the container 2, filling means for filling the container 2, and welding means for sealing the aperture 5 on termination of filling.

Each component will now be described in greater detail, by following a filling cycle for the container 2.

A fluid material is fed from a feed source, not shown, via a conduit, also not shown, to a movable nozzle 8, which is provided at its end with delivery mouth 9 for the fluid material.

The nozzle 8 is disposed substantially vertical with its mouth 9 facing downwards.

The nozzle 8, of circular cross-section, is intercepted by a piston 10 movable between an advanced position in which it prevents fluid passage from the feed source to the nozzle 8, and a retracted position in which it allows the fluid to pass from the feed source to the nozzle 8.

The piston 10 is operated by means of the known art.

The nozzle 8 is movable between a retracted position and an advanced position within a guide jacket 6 which defines a sterile internal environment isolated from the outside.

Within the jacket 6, to the side of the nozzle 8, there are two small-diameter wash conduits 11 fed by a source, not shown, containing a sterile wash fluid, for example steam or condensed steam.

The two wash conduits 11 terminate with apertures 12 facing the delivery mouth 9, as shown in FIG. 1.

When washing is underway, the wash fluid emerges from the two conduits to clean the delivery mouth 9, this operation generally taking place on termination of filling.

On the lower portion of the nozzle 8 in proximity to the delivery mouth 9 there are located, coaxial to the nozzle 8 and external thereto, an upper ring 13 and a lower ring 14 each of substantially oval shape, and more exactly of almond shape.

The upper ring 13 has its lower and upper surfaces substantially parallel to each other and perpendicular to the axis of the nozzle 8; the lower ring 14 has its upper surface perpendicular to the axis of the nozzle 8 and facing the lower surface of the upper ring 13.

The lower surface of the lower ring 14 is concave and converges upwards, into it there opening at 12 the two wash conduits 11 which therefore pass through said rings 13 and 14 (FIG. 1).

The fluid delivery mouth 9 is of duckbill shape, to resemble a sort of deformable cylinder having its lower end closed when not traversed by the fluid material.

The mouth 9 is formed of an elastomer material, such as rubber.

Because of its particular shape and the material used for its formation, the mouth 9 remains closed when not traversed by the fluid material.

Figure 2:
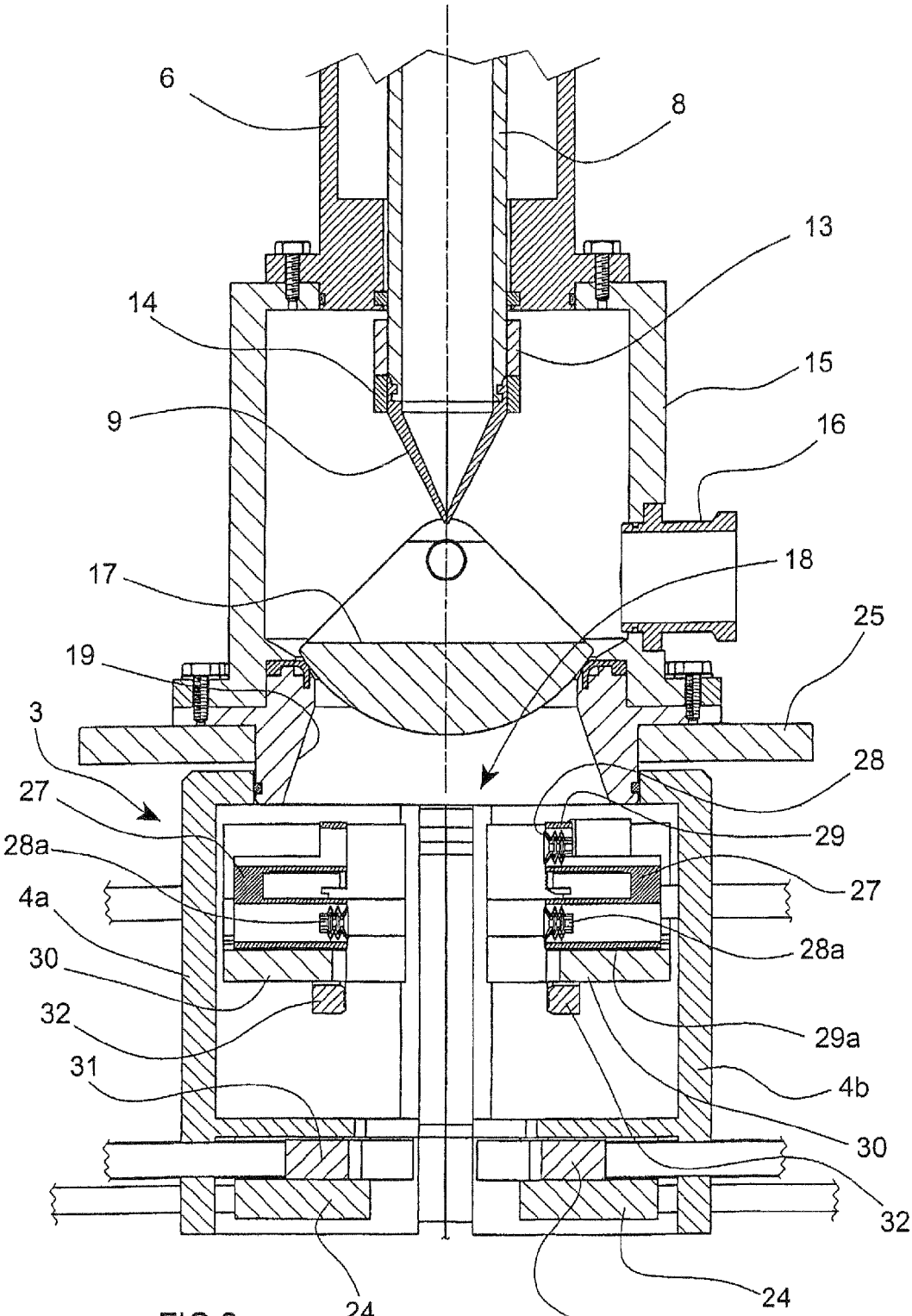
FIG. 2 is a vertical section, taken on a plane perpendicular to that of FIG. 1, through a detail of FIG. 1.

Both the delivery mouth 9 and the two rings 13, 14 are contained within a sterile wash chamber 15 isolated from the outside environment and in communication only with the discharge conduit 16 for the wash and sterilization fluid, as visible in FIG. 2.

The wash and sterilization fluid emerges from the conduit 16 to wash and sterilize not only the conduit through which the material is fed, but also the mouth 9, the two rings 13, 14 and the entire interior of the sterile chamber 15, before each production commencement.

The jacket 6 and the movable nozzle 8 are located above said chamber 15, said jacket 6 being associated with the upper surface of the chamber 15.

The sterile chamber 15 is of cylindrical shape and is in fluid communication via a passage channel 19 with the box 3 located below the sterile chamber 15.

This communication is possible as the cylindrical chamber 15 has no lower surface, and the box 3, of substantially parallelepiped shape, presents a first circular opening 18 in its upper surface.

Figure 3:
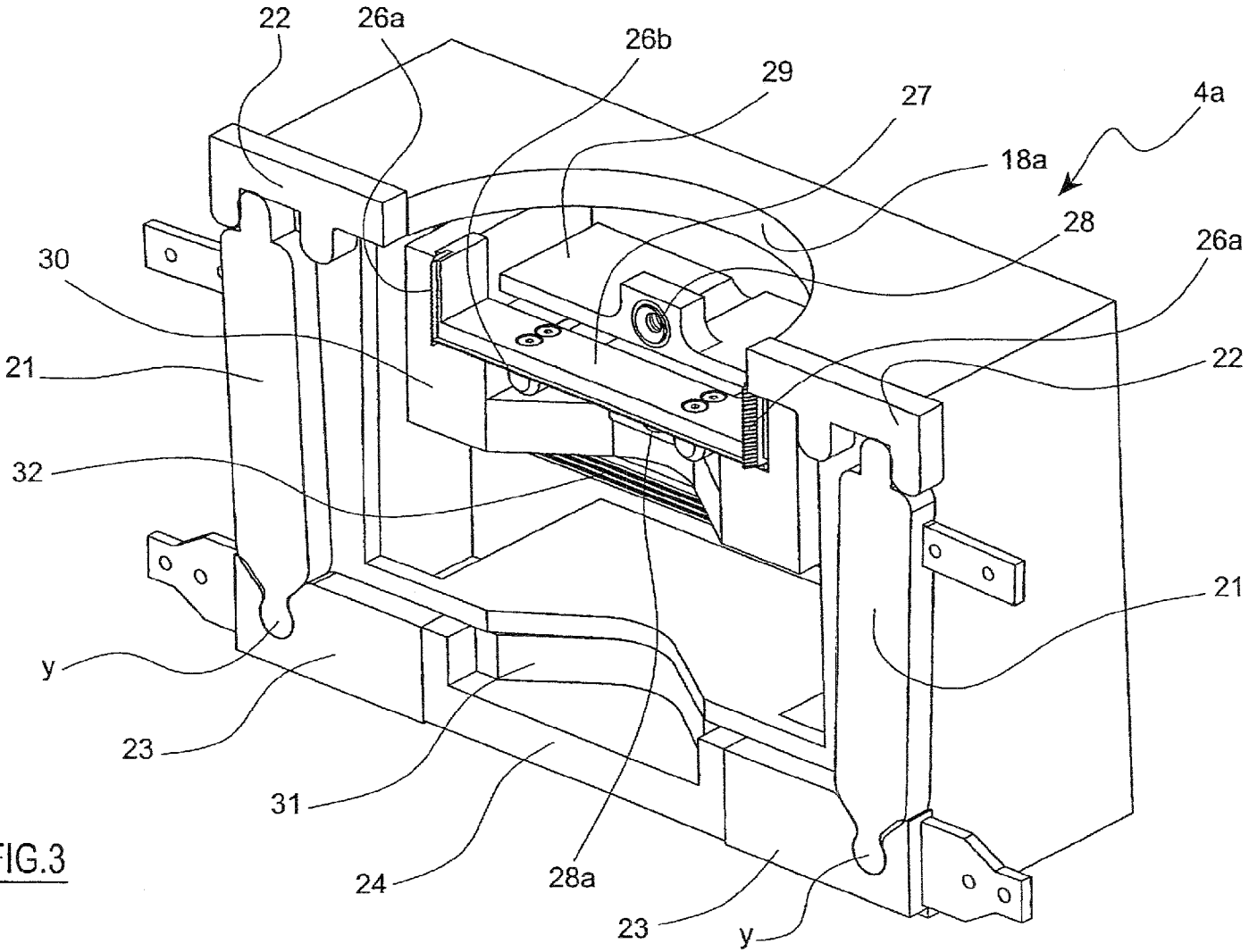
FIG. 3 is a perspective view of a half-box.

Said circular opening 18 is defined by two semicircular edges 18*a* present on each half-box 4*a*, 4*b* (FIG. 3).

The passage channel 19 presents a circular outer surface (FIG. 2) which is able to seal against the semicircular edges 18*a* of the first opening 18 and is preferably formed of an elastomer material.

The sterile chamber 15 is rigidly associated with a plate 25 located above the box 3 and having an aperture through which the passage channel 19 is inserted.

The passage channel 19 extends below the plate 25 by an amount sufficient to enable it to enter the first opening 18 of the box 3 and form a seal.

Essentially, when the two half-boxes 4*a*, 4*b* are withdrawn apart, the passage channel 19 connects the outside environment to the sterile chamber, whereas when the two half-boxes 4*a*, 4*b* are connected together a single region isolated from the outside environment is formed; this region is represented by the combination of the chamber 15 and box 3 (FIG. 2).

To isolate the chamber 15 from the outside environment or from the box 3 a shut-off valve 17 is provided, this being a hemispherical valve in the example, which when closed obstructs the passage channel 19.

The valve 17 can be made to open and close by usual means of the known art.

The half-boxes 4*a* and 4*b* can be coupled together along respective sealing edges lying in two respective parallel vertical planes.

Because of the particular shape of the two half-boxes 4*a*, 4*b*, the edges do not form a continuous surround, but form a surround interrupted upperly and lowerly in the central part.

Figure 4:
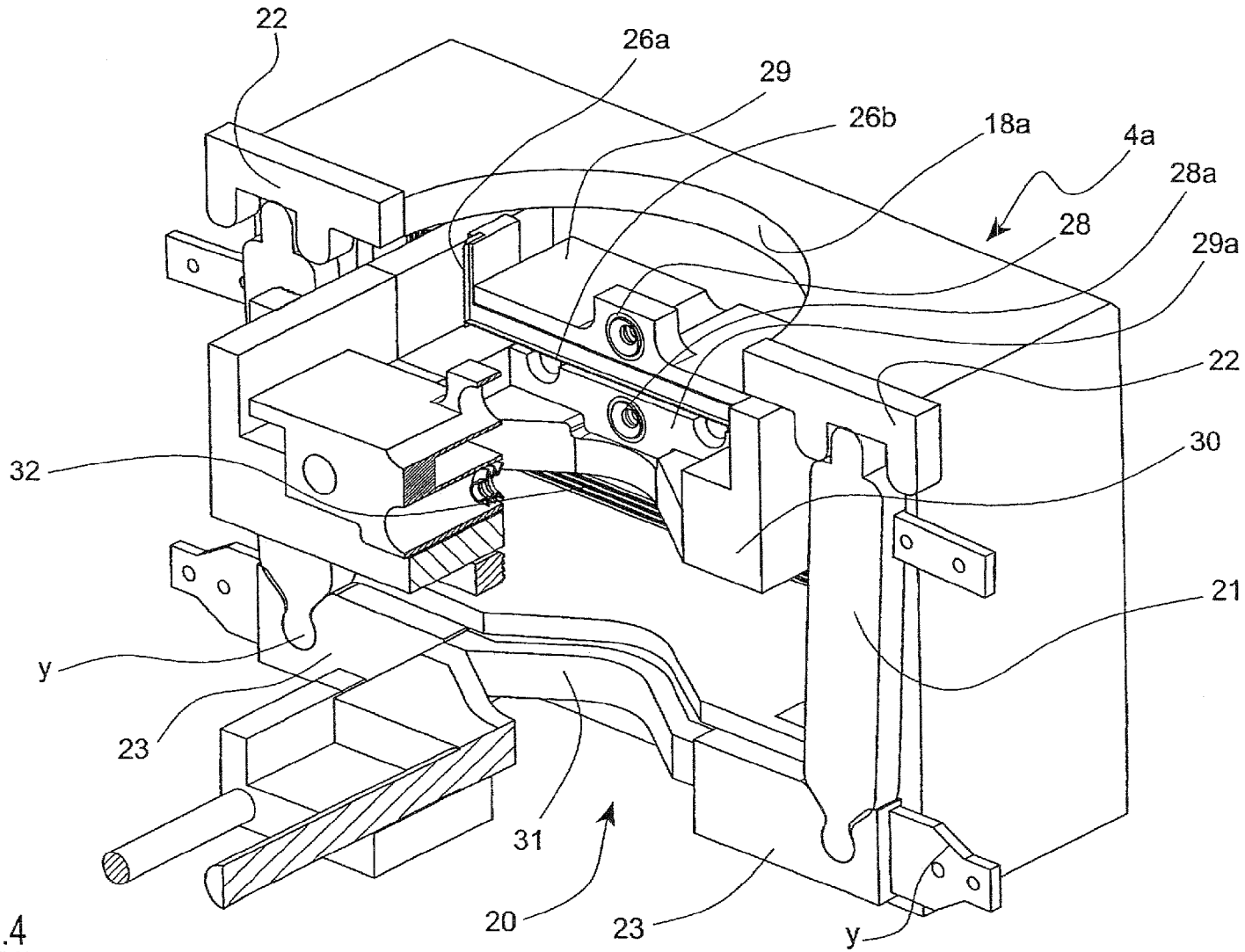
FIG. 4 is a perspective view of one half-box and of some parts of the other half-box.
Figure 5:
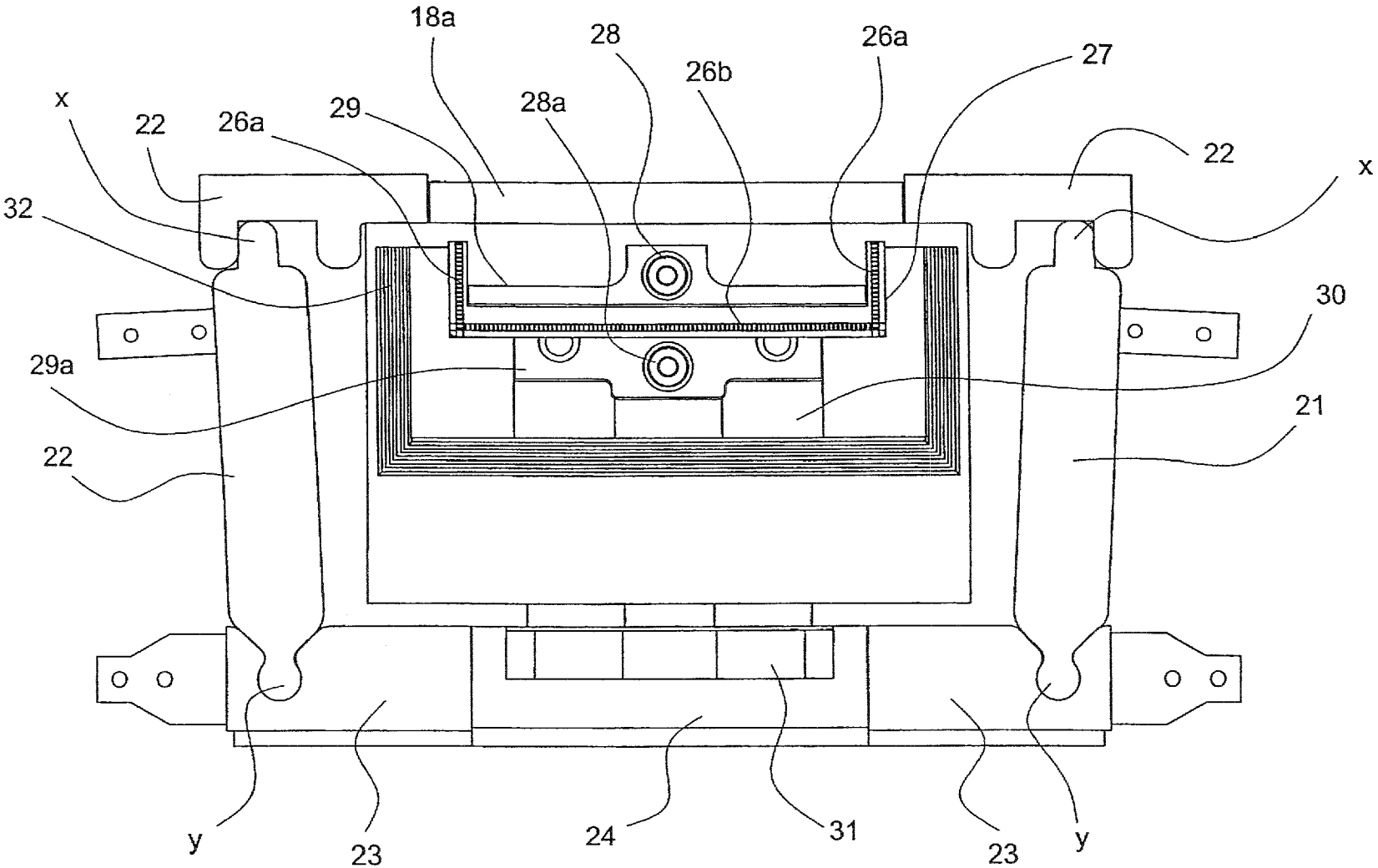
FIG. 5 is a front view of the interior of the half-box of FIG. 3.

These interruptions are due to the presence of the first opening 18 in the upper surface of the box 3 (FIG. 6A) and the presence of a second opening 20 provided in the lower surface of the box 3 (FIG. 4). Gaskets are preferably associated with the abutting sealing edges.

The gaskets which abut to form the seal comprise two lateral gaskets 21, two upper gaskets 22 at the sides of the first opening 18 and two lower gaskets 23 at the sides of the second opening, as shown in FIG. 3. Essentially, the left upper gasket 22, the left lateral gasket 21 and the left lower gasket 23 assume a C-shape, whereas the right upper gasket 22, the right lateral gasket 21 and the right lower gasket 23 assume a shape the specular image of said C-shape.

In practice, the two C-shapes of one and the same half-box 4*a*, 4*b* face each other.

To ensure that the box 3 is sealed against the outside environment, the lower second opening 20 is closed by two sealing carriages 24 (FIG. 3) of elastomer material which, when positioned abutting each other, form a seal to isolate the entire box 3 from the outside environment.

Likewise, air from the outer environment is unable to penetrate via the first opening in the top of the box 3, as it is sealedly associated with the channel 19.

To fill the container 2 with the fluid material, the sealed empty container 2 is positioned vertically between the two half-boxes 4*a* and 4*b*, so isolating from the outside environment that portion of the container 2 between the sealing edges of the two closed half-boxes 4*a* and 4*b*.

The upper edge 2*a* of the container 2 is positioned horizontally, just below the upper gaskets 22 (FIG. 1).

In practice, the container 2 is retained by the lateral gaskets 21 and lower gaskets 23 and, in the central lower part, by the sealing carriages when positioned abutting.

The interior of the box 3 and that portion of the container 2 lying in its interior are sterilized by suitable sterilizing fluids which reach the interior of the box 3 via a suitably directed conduit, not shown, in accordance with the known art.

In addition, sterile air is fed under slight pressure into the box 3, after its sterilization, to prevent any internal air seepage from the outside environment.

Aperture-forming means are present in the box 3 to form the aperture 5 in the container 2 in that container portion isolated from the outside within the box 3.

Figure 7:
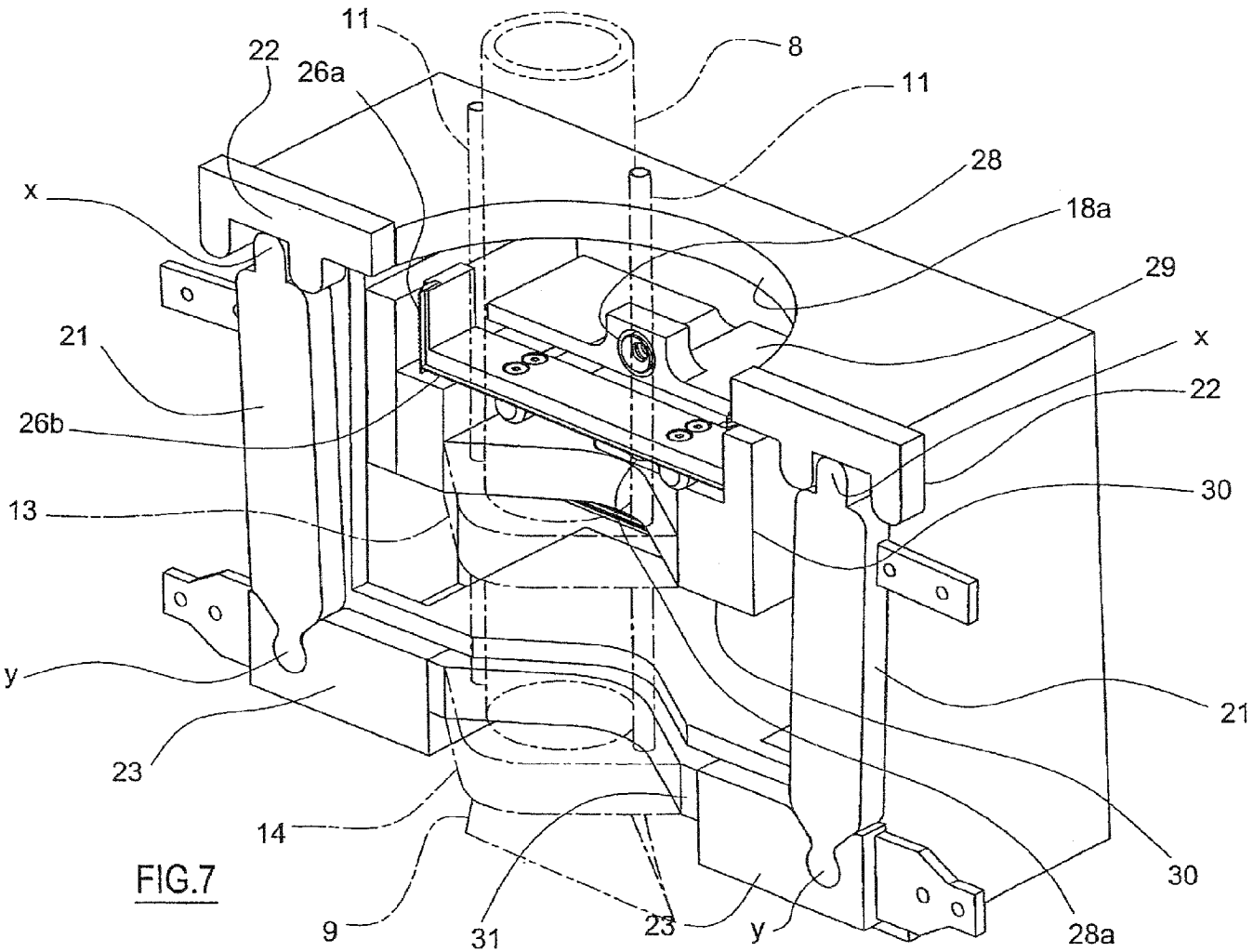
FIG. 7 is a perspective view of the half-box of FIG. 3 in a filling stage (the container 2 is not shown in order to leave other elements visible)
Figure 7A:
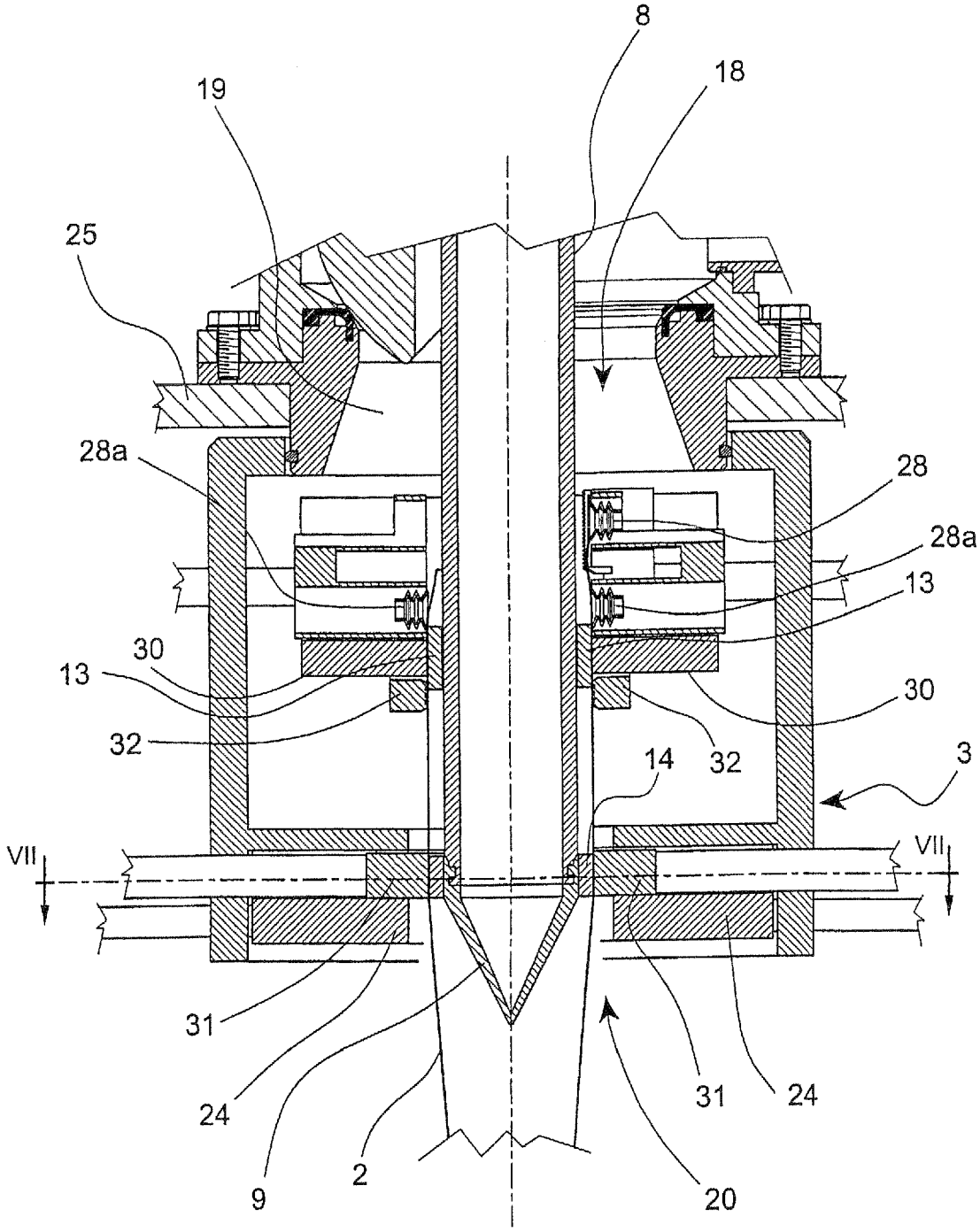
FIG. 7A is a vertical section on the plane II-II of FIG. 1 through the box in the stage shown in FIG. 7.
Figure 7B:
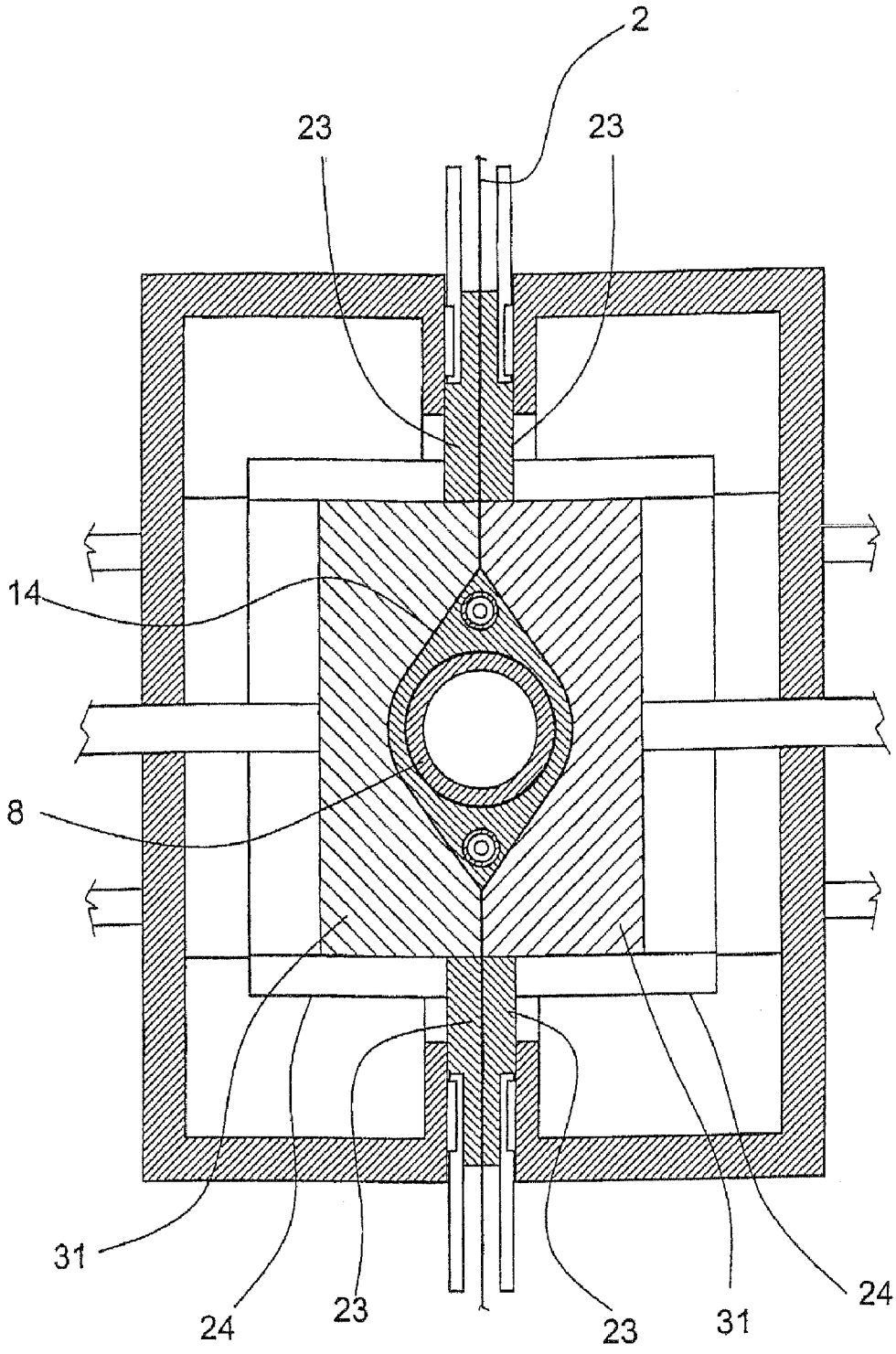
FIG. 7B is a horizontal section on the plane VII-VII of FIG. 7A.
Figure 7C:
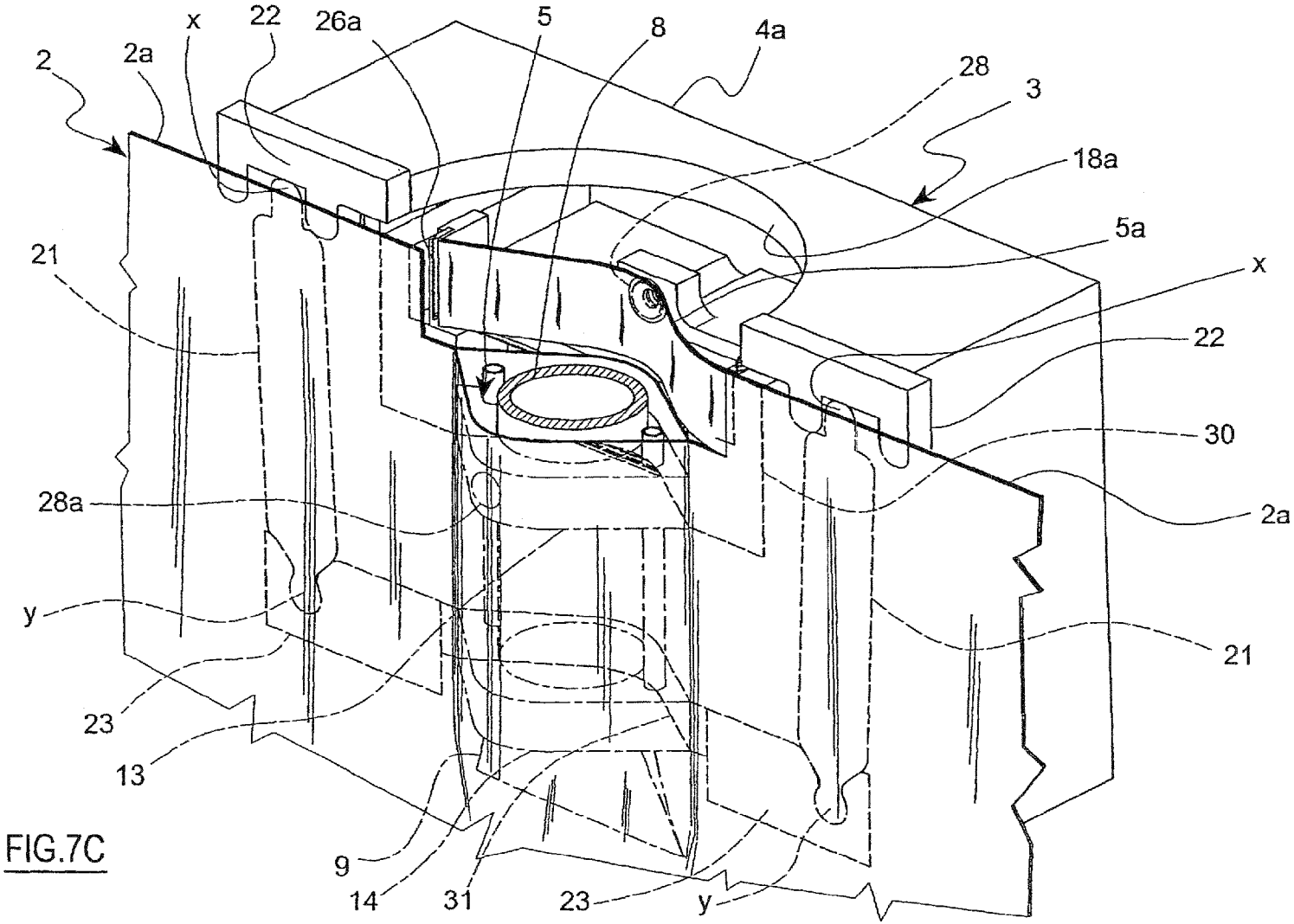
FIG. 7C shows the same elements as FIG. 7, but with the container 2 visible.

Said aperture-forming means consist of a pair of vertical lateral blades 26*a* and a horizontal transverse blade 26*b*, to cut the container 2 and form the aperture 5 (visible in FIG. 7C).

Said blades 26*a* and 26*b* are disposed as a U, the blade lengths being a function of the dimensions of the aperture 5 to be obtained.

The blades are associated at their front with a blade carriage 27 slidable within one of the two half-boxes 4*a* (or 4*b*) to abut against a backing element associated with the other half-box 4*b* (or 4*a*) also slidable.

In operation, a cut is made in the container 2 by the blades 26*a*, 26*b*, and the cut part 5*a* is moved away from the aperture 5 by the operation of an upper sucker 28 positioned on the front of a sucker carriage 29 which can move within the box 3 above the transverse blade 26*b*.

The sucker carriage 29 is removably associated with one of the two half-boxes 4*a* (or 4*b*), a flat counteracting surface being present in the opposite half-box 4*b* (or 4*a*).

To prevent container portions being totally removed from the container as a result of cutting the aperture 5, just one lateral blade 26*a* could be used in addition to the horizontal blade 26*b*, or merely the horizontal blade 26*b* itself.

In this case the cut portion subsequently pulled away by the sucker 28 remains connected to the container 2 along the lateral folding line which, if the second lateral blade 26*a* had also been used, would have been cut through.

To fill the container 2, the aperture 5 must enable the delivery mouth 9 to be inserted through it and hence must be suitably widened out.

To widen the aperture 5, means are provided to draw apart the two contacting thin sheets of the container 2 in order to widen said aperture 5. These means consist of one or more lower suckers 28*a* positioned at the front of a pair of opposing sucker carriages 29*a*, which can be moved apart within the box 3 below the transverse blade 26*b* after gripping the respective sheets of the container 2.

The three carriages 27, 29 and 29*a* can be moved simultaneously or indeed be rigid with each other.

While the lower suckers 28*a* are being moved apart, the two lateral gaskets 21 must be rotated inwards, for which reason they are made movable. For this purpose the two lateral gaskets 21 are associated with the corresponding edges so as to be able to rotate about a lower rotation point y. The movement of the two lateral gaskets 21 takes place before or simultaneously with the withdrawal of the suckers 28*a*.

By forming the aperture 5, the interior of the box 3 is put into communication with a small internal portion of the container 2.

In this respect, as the two lower sealing carriages 24 are closed, most of the interior of the container 2, i.e. all that part surrounding the box 3, is still not in communication with the interior of the box 3.

When the aperture 5 has been suitably widened, the valve 17 is opened to put the box 3 into communication with the sterile chamber 15 where the end part of the nozzle 8, the delivery mouth 9 and the two oval rings 13, 14 are removably disposed.

The nozzle 8 is lowered into the box 3 through the connection channel 9 until the rings 13, 14 and the mouth 9 lie within that portion of the container 2 enclosed within the box 3.

Each half-box 4*a*, 4*b* comprises an upper movable pressing carriage 30 to be positioned about the upper ring 13 and seal thereagainst.

Said pressing carriages 30 are located below the region in which the aperture 5 is made in the container, below the sucker carriage 29*a*, as shown in FIG. 3.

Essentially, when the upper ring 13 by penetrating into the open portion of the container 2 reaches the point where the upper pressing carriages 30 are positioned, these latter embrace the upper ring 13 with a form fit via the interposed sheets of the container, such as to form a seal thereagainst.

The perfect seal between the pressing carriages 30 and the upper ring 13 hermetically seals the container 2 slightly below the aperture 5, to sealedly isolate the container interior from the outside environment; for example it prevents the slightly pressurized sterilizing fluid present in the box 3 from penetrating into the container 2 through the aperture 5.

Figure 6:
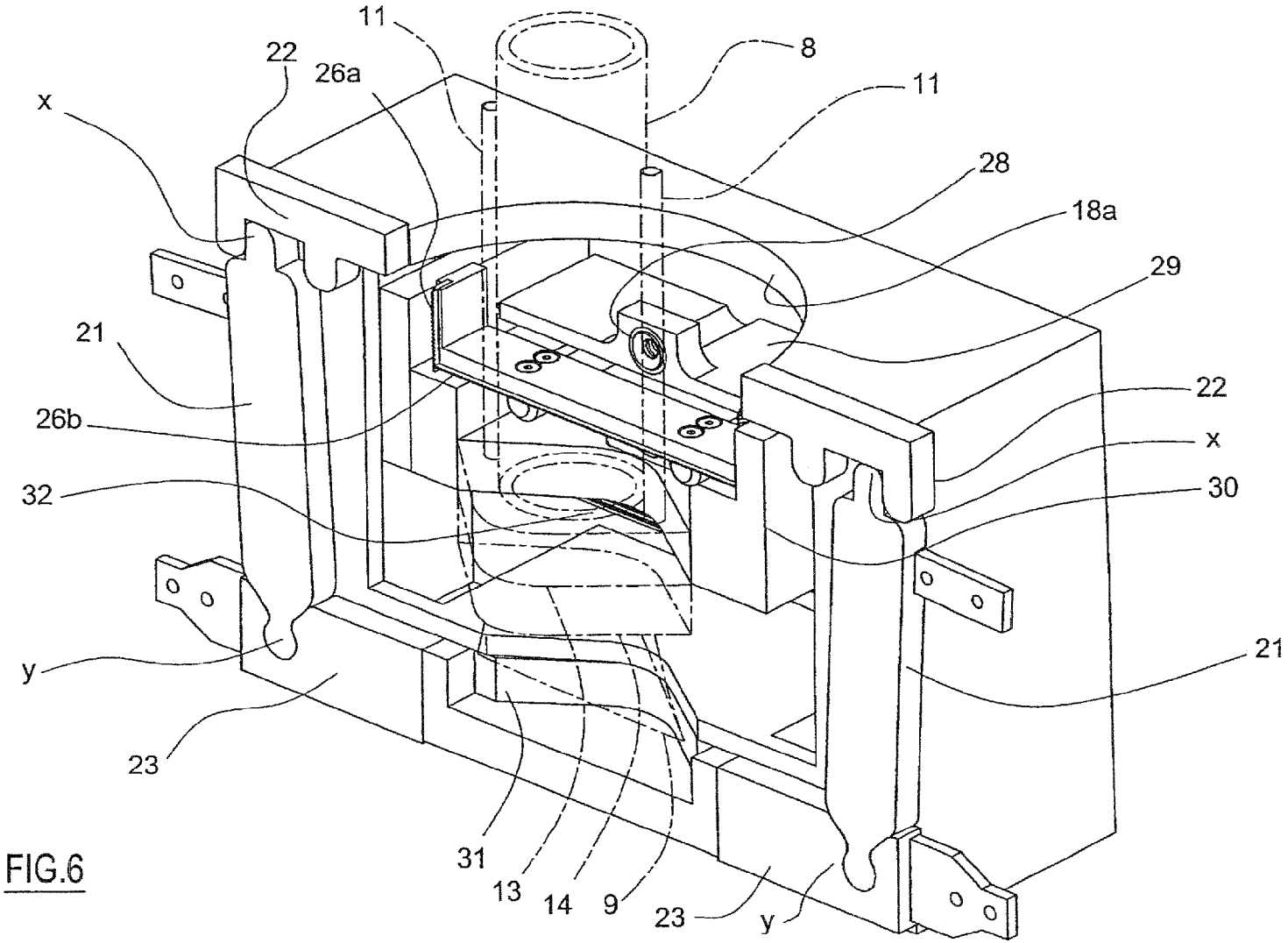
FIG. 6 is a perspective view of the half-box of FIG. 3 in a pre-filling stage (the container 2 is not shown in order to leave other elements visible)
Figure 6A:
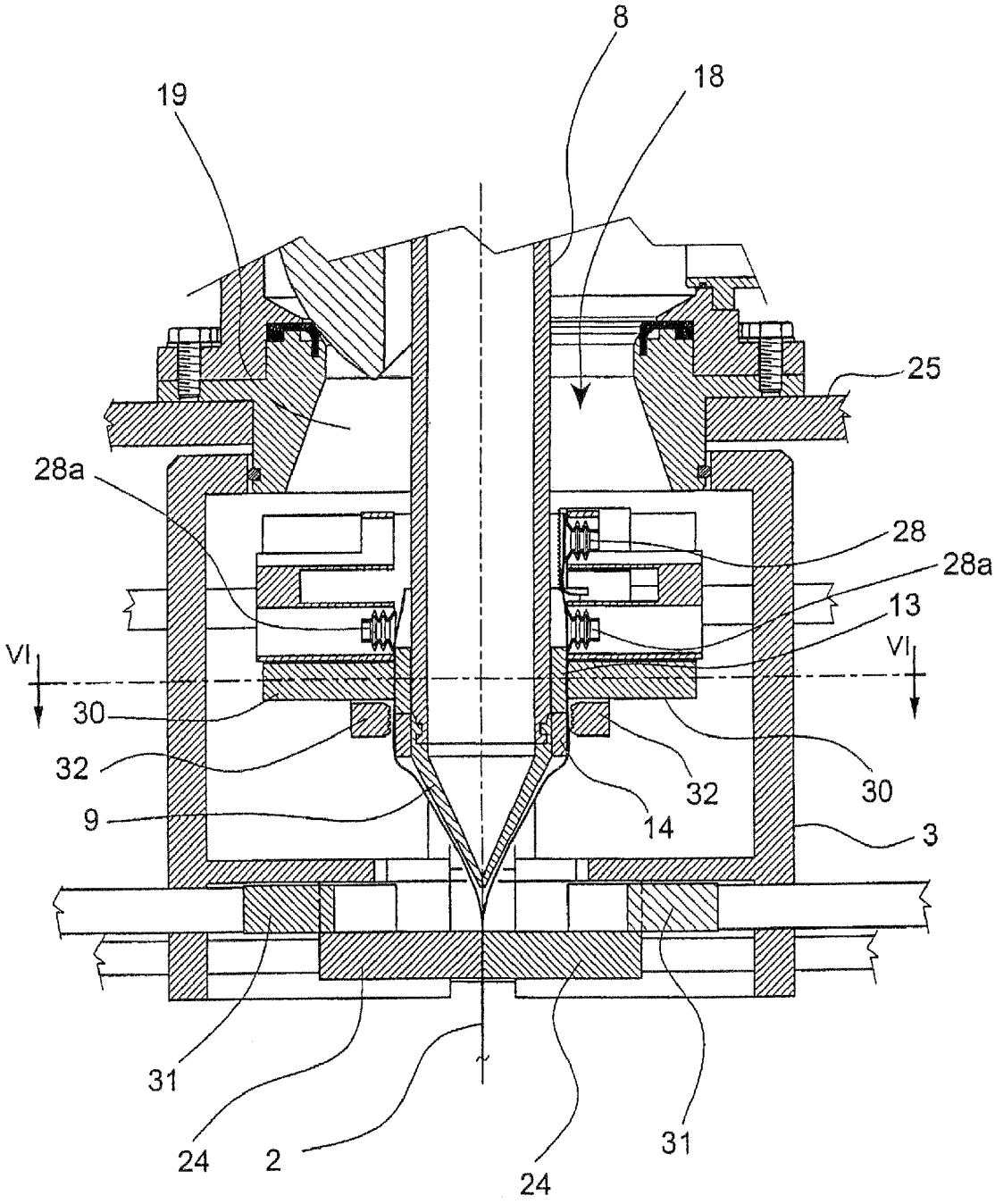
FIG. 6A is a vertical section on the plane II-II of FIG. 1 through the box in the stage shown in FIG. 6.
Figure 6B:
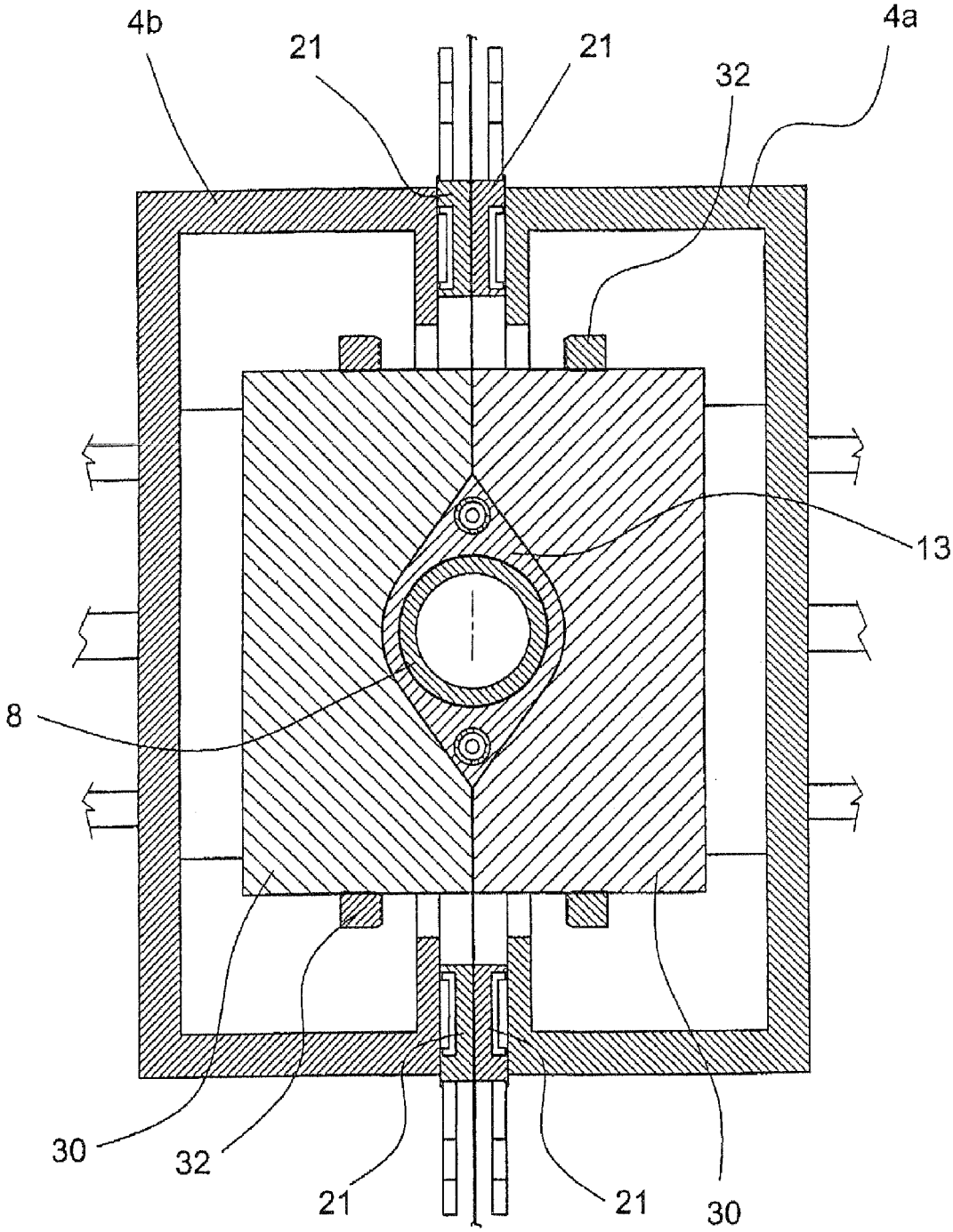
FIG. 6B is a horizontal section on the plane IV-IV of FIG. 6A.

On reaching this position, shown in FIGS. 6, 6A and 6B, the nozzle 8 together with the lower ring 14 and the mouth 9 positioned inside the container 2 are free to move vertically along their common axis.

Having formed the seal between the upper ring 13 and the two upper pressing carriages 30, in the next stage the two lower pressing carriages 24 are withdrawn to release the second opening 20. At the same time the two lower gaskets 23 are moved towards each other to enable the two sheets of the container 2 to move apart at the opening 20 and leave a passage free for the nozzle 8.

The movement of the two lower gaskets 23 is accompanied by the inward rotation of the two lateral gaskets 21, which are associated with the corresponding edges so as to be also able to rotate about an upper rotation point x At this point, the nozzle 8, the mouth 9 and the lower ring 14 advance downwards within the container 2, which is now ready to be filled.

When the lower ring 14 comes into proximity with the spaced-apart sealing carriages 24, it is embraced via the container sheets by two lower pressing carriages 31, which have the same form and function as the aforedescribed upper pressing carriages 30 (FIG. 7).

It should be noted that both the upper pressing carriages 30 and the lower pressing carriages 31 are located within the box 3.

Moreover the material with which said carriages 30, 31 are formed is preferably of elastomer type able to form a seal.

The perfect seal between the lower pressing carriages 31 and the lower ring 14, together with the line of gaskets 21, 22, 23, hermetically isolates that part of the container interior lying below the second opening 20 from that part of the container interior lying above the opening 20; in practice it prevents the fluid filling material from reaching, for example by splashing or natural back flow, that inner portion of the container 2 present between the lower ring 14 and the upper ring 13.

This enables the inner portion of the container 2 to be safeguarded from any soiling which may be caused while filling the container 2 with the fluid material.

The drive means for all the carriages 27, 29, 29*a*, 30, 31 present in the box are the usual means of the known art and will therefore not be described in detail.

Moreover, all the carriages 27, 29, 29*a*, 30, 31 move perpendicular to the plane in which the container 2 lies.

The filling of the container 2 commences when the upper ring 13 and the lower ring 14 are sealedly embraced by the respective pressing carriages 30, 31.

When the container 2 has been filled, the nozzle 8 is extracted from the box 3 by carrying out the described operations in the reverse direction. Before the delivery mouth 9 is extracted from the container 2, it is washed by the wash fluid passing through the two wash conduits 11 located at the to sides of the mouth.

This wash prevents soiling of the interior of the container 2, so facilitating the subsequent welding operations.

The welding operations on the aperture 5 are carried out by welding means 32, in particular high temperature means, which seal the aperture on termination of filling.

These welding means 32 are located in the box 3 below the sucker carriage 29*a* and, for example, are associated with this carriage 29*a*. Preferably, the machine of the present invention comprise further retention means for maintaining the container 2 in the vertical position.

In the example illustrated in FIG. 1, these retention means are in the form of two clamps 34, each clamp provided with two jaws 35. The clamps 34 are positioned to the side of the sealing box 3 and are operated by usual cylinder-piston units 35.

The clamps 34 enable the soft container 2 to be held under slight tension.

In this respect, the jaws 35 grip the container 2 at the upper lateral ends of the container, the two clamps 34 acting by withdrawing from the box 3 along a horizontal line.

It should be noted that when the aperture 5 of the container 2 is widened out, the two clamps 34 are made to move towards the box 3 by the cylinder-piston units 36, to enable the lateral gaskets 21 to approach each other without tearing the container 2, which is under tension.

As will be appreciated from the aforegoing description, the machine for filling soft containers in an aseptic environment according to the present invention satisfies the requirements and overcomes the problems stated in the introduction to the present description with reference to the known art.

In this respect, the machine of the present invention enables already internally sterile stopper-less containers to be filled.

By using containers of this type, the material packaging costs are drastically reduced because of the lower container cost compared with the cost of stoppered containers used in the known art.

Another advantage is that by welding the container when full in accordance with the invention, mould formation is prevented, in contrast to containers of classical type where this cannot be guaranteed.

The ability to use the machine of the present invention by automatically arranging the containers to be filled without the aid of any operator is also a decided advantage.

To satisfy specific contingent requirements, an expert of the art can apply numerous modifications and variants to the aforedescribed machine for filling soft containers in an aseptic environment, all falling within the scope of protection of the invention, as defined by the following claims.

The invention claimed is:

1. A machine for filling a soft container (2) with a fluid material, said container (2) comprising two thin sheets sealedly joined together along a perimeter bounding the container (2) and being internally sterile, characterised by comprising:

a sealing box (3) comprising two complementary half-boxes (4*a*, 4*b*) that can be clamped together, said two half-boxes (4*a*, 4*b*) having respective sealing edges (21, 22, 23) which can be brought into mutual contact to isolate their interior from the outside environment when said complementary half-boxes (4*a*, 4*b*) are clamped together, said container (2) being positioned vertically and retained by said edges (21, 22, 23) with at least one portion inserted into said box (3), said portion being isolated from the outside;

aperture-forming means (26*a*, 26*b*, 26*c*) located in said sealing box (3) to form an aperture (5) in said container portion inserted in the box (3)

means for widening the aperture (5) to a predetermined dimension;

filling means (8, 9) for filling said container (2) with the fluid material through said aperture (5);

welding means (32) for sealing said aperture (5) on termination of filling.

2. A machine as claimed in claim 1, in which said interior of said sealing box (3) communicates, via a first opening (18) provided in the top of the two clamped-together half-boxes (4*a*, 4*b*), with a chamber (15) isolated from the outside environment, and which further comprises valve means (17) arranged to interrupt communication between said chamber (15) and said box (3), such as to form a sterile chamber in which a cleaning/sterilization of the filling means (8, 9) takes place.

3. A machine as claimed in claim 2, wherein said filling means comprise a feed conduit fed by a feed source and having a movable nozzle (8) provided with a delivery mouth (9).

4. A machine as claimed in claim 3, wherein said nozzle (8) is movable from a retracted position, in which the delivery mouth (9) lies within said chamber (15), to an advanced position, in which said delivery mouth (9) lies inside the container (2).

5. A machine as claimed in claim 4, wherein two lower gaskets (23) of the sealing edge are moved towards each other to enable the two sheets of the container (2) to move apart at the lower opening (20) in order to leave a passage free for the nozzle (9).

6. A machine as claimed in claim 2, wherein the edges of said half-boxes (4*a*, 4*b*) form a sealing surround interrupted lowerly by a lower opening (20), said half-boxes (4*a*, 4*b*) comprising two sealing carriages (24) arranged to close said lower opening (20) and two lower pressing carriages (31) arranged to embrace, by way of the interposed container-forming sheets, a lower ring (14) against which they form a seal to hermetically isolate that part of the container interior lying above the lower opening (20) from that part of the container interior lying above the lower opening (20).

7. A machine as claimed in claim 2, wherein each half-box (4*a*, 4*b*) comprises an upper movable pressing carriage (30) located below the region in which the aperture (5) is made in the container, and arranged to position itself about the upper ring (13) by way of the interposed container-forming sheets and form a seal against it, the seal between the pressing carriages (30) and an upper ring (13) hermetically sealing the container (2) slightly below the aperture (5), to sealingly isolate the container interior from the outer environment.

8. A machine as claimed in claim 1, wherein said aperture-forming means comprise at least one blade (16*a*, 16*b*) arranged to cut said container (2) in order to form its aperture (5).

9. A machine as claimed in claim 1, comprising means (28, 29) for mutually withdrawing the two contacting thin sheets of the container (2) in order to widen said aperture (5), said withdrawing means (28, 29) being positioned within the box (3).

10. A machine as claimed in claim 9 wherein, simultaneously with the mutual retraction of said withdrawing means (28, 29), two lateral gaskets (21) of the sealing edges of the two half-boxes (4*a*, 4*b*) are rotated inwards, for which purpose they are associated with the corresponding edges so as to be able to rotate about a lower rotation point (y).

11. A machine as claimed in claim 1, comprising retention means (33, 34, 35, 36) for maintaining said container (2) in a vertical position.

12. A machine as claimed in claim 11, wherein said retention means comprise two pairs of clamps (34) with jaws (35) disposed to the side of the sealing box (3).

* * * * *